United States Patent [19]

Bianchi et al.

[11] 4,379,770

[45] Apr. 12, 1983

[54] CARBURETTORS FOR INTERNAL COMBUSTION ENGINES

[75] Inventors: Valerio Bianchi, Neuss; Anwar Abidin, Meerbusch; Dieter Thönnessen, Viersen, all of Fed. Rep. of Germany

[73] Assignee: Bosch & Pierburg System ohG, Neuss, Fed. Rep. of Germany

[21] Appl. No.: 292,736

[22] Filed: Aug. 14, 1981

[30] Foreign Application Priority Data

Apr. 7, 1981 [DE] Fed. Rep. of Germany ..... 3113943

[51] Int. Cl.³ ..... F02M 15/04

[52] U.S. Cl. ..... 261/142; 261/79 R; 261/145; 261/50 A; 261/DIG. 74; 123/523; 123/545; 123/549; 55/DIG. 28

[58] Field of Search ..... 261/50 A, 145, 144, 261/142, 79 R, DIG. 74; 123/523, 545, 549; 55/DIG. 28

[56] References Cited

U.S. PATENT DOCUMENTS

| | | | |
|---|---|---|---|
| 578,683 | 3/1897 | Tregurtha | 261/50 A |
| 1,150,115 | 8/1915 | Heinze, Jr. | 261/142 |
| 1,273,356 | 7/1918 | Good | 261/50 A |
| 1,294,182 | 2/1919 | Severson | 261/50 A |
| 1,322,654 | 11/1919 | Thomas | 261/145 |
| 2,167,892 | 8/1939 | Kent et al. | 261/50 A |
| 2,210,055 | 8/1940 | Atkins | 261/50 A |
| 3,259,378 | 7/1966 | Mennesson | 261/50 A |
| 3,414,242 | 12/1968 | Bouteleux | 261/79 R |
| 3,743,258 | 7/1973 | Florentine | 261/142 |
| 4,001,356 | 1/1977 | Graybill | 261/144 |

FOREIGN PATENT DOCUMENTS

| | | | |
|---|---|---|---|
| 2037893 | 7/1980 | United Kingdom | 261/44 F |
| 2064657 | 6/1981 | United Kingdom | 261/142 |

*Primary Examiner*—Tim R. Miles

*Attorney, Agent, or Firm*—Toren, McGeady and Stanger

[57] ABSTRACT

A constant pressure carburettor comprises a mixing chamber 2 which is surrounded by a heating jacket 12, an operator controlled throttle valve 3 at the downstream end of the chamber 2, a fuel feeder 5, 6 at the upstream end of the mixing chamber and a choke valve 10 at an air inlet to the carburettor. The choke valve 10 is, in use, controlled automatically by the air flow into the carburettor in dependence on the opening of the throttle valve 3 and the speed of the engine to which the carburettor is fitted. The choke valve 10 tends to produce vortices or turbulence in the air flow and this tends to cause the fuel supplied by the feeder 5, 6 to the wall of the chamber 2 to be prematurely removed before it is heated. This adversely affects the vaporisation of the fuel and the formation of the air-fuel mixture. To avoid turbulence or vortices in the chamber 2, a stabilisation conduit 16 is provided between the choke valve 10 and the fuel feeder 5, 6. The conduit 16, which preferably has two right-angle bends as shown, damps out or at least decreases the vortices or turbulence in the air flow before it reaches the mixing chamber 2.

18 Claims, 6 Drawing Figures

CARBURETTORS FOR INTERNAL COMBUSTION ENGINES

This invention relates to constant pressure carburettors for internal combustion engines; the carburettor comprising a tubular wall surrounding a main air flow path and mixture chamber, which is provided upstream with a fuel feeder which supplies fuel in a substantially uniform circumferential distribution on to the tubular wall, part of which, substantially between the region of the fuel feeder and a main throttle valve downstream of the mixing chamber, is formed as a heating wall, and a choke valve disposed upstream of the fuel feeder, the choke valve opening in dependence upon the magnitude of the air flow along the main flow path and actuating a metering element which regulates the fuel flow rate from the fuel feeder.

A recently proposed carburettor having these features produces trouble-free evaporation of fuel in the mixture before it reaches an intake pipe from the mixing chamber with good transportation and distribution of the mixture. At the entry of the mixture into the intake pipe, virtually no liquid fuel constituents remain in the mixture and wetting of the tubular wall is restricted substantially to that surrounding the mixing chamber. In the mixing chamber, the heat supplied via the heating wall produces a direct heating-up and evaporation of the fuel film on the wall over a short distance, without the temperature of the intake mixture being unacceptably raised. On account of the rapid evaporation of the fuel taking place over a short distance, no decisive errors in composition of the intake mixture occur during non-steady operation of the engine to which the carburettor is fitted.

In the proposed carburettor, however, air vortices may be produced in the region of the fuel feeder and of the heating wall, these being caused by the choke valve situated in the aspirated air stream. As a consequence of these vortices, the fuel may not reach the heating wall at all or may shortly after reaching it be sucked away from it again. As a result the effect of the heating wall which improves the mixture preparation may be partly lost.

The object of the present invention is to construct a constant pressure carburettor as initially described in such a way that an undisturbed fuel film can be attained on the heating wall. The fuel film should persist for a sufficiently long time to produce virtually complete fuel evaporation.

To this end, according to this invention, a constant pressure carburettor as initially described is provided with a flow stabilizing conduit extending between the choke valve and the fuel feeder, the stabilizing conduit being constructed so that it damps out or decreases vortices generated by the choke valve in the air flow to the mixing chamber.

As a result of the provision of the stabilizing conduit a largely vortex-free or turbulence-free flow is produced in the region of the fuel feeder and of the heating wall. The vortices or turbulence which unavoidably form downstream of the choke valve are gradually dissipated, so that the fuel feeder and the heating wall lie in a flow-stabilized region. The fuel can be supplied in a simple manner to the heating wall and can be held there until it has substantially completely evaporated. Since the flow speed in the flow-stabilized mixing chamber decreases from its centre towards the heating wall, the fuel film on the wall is accelerated only insignificantly in the flow direction by the air flowing over it so that the fuel film persists on the heating wall for long enough to achieve proper evaporation of the fuel.

Preferably, the heating wall is disposed substantially vertically when the carburettor is in its operating position. Since, particularly in the region of the heating wall, the air speed is low, as a result of the vertical arrangement a gravity-dependent positive transportation of the fuel film on the wall in the main air flow direction is achieved. In this way flow-stagnating regions of the fuel film on the wall can be avoided.

In a preferred embodiment, the flow-stabilizing conduit has one or more bends. The magnitude of the angle of the bend, or the total angles of the bends, is preferably in the range from substantially 90° to substantially 180°. As a result of the bend or bends, in spite of the conduit between the choke valve and the fuel feeder having to be comparatively long, a relatively compact, space-saving carburettor construction can be attained. When the heating wall is vertically arranged, an excessively large overall height of the carburettor can be avoided by the bends in the flow stabilizing conduit. Considered overall, the bends make possible an appropriate adaptation of the shape of the carburettor to the space available in any particular installation.

In one example, an air filter is incorporated into the flow stabilizing conduit. This is preferably an annular air filter having its inside leading into the mixing chamber and being arranged so that the air can flow around its external periphery. This integrated form of construction makes possible a further reduction in the overall size of the carburettor since an additional air filter upstream of the choke valve is not necessary and the space occupied by the flow stabilizing conduit is also utilized additionally for air filtering. This form of construction does not prevent a float chamber of the carburettor from being connected in the usual manner to the clean air side of the air filter.

In one embodiment, the flow stabilizing conduit has a transition which tapers gradually into the mixing chamber. The flow stabilizing conduit, which then has a larger cross section than the mixing chamber, can then be made relatively short. At the inlet to the mixing chamber, the reduction in cross-section produces a corresponding acceleration of the air flow. By the gradual taper of the transition, the forming of vortices is prevented at the inlet to the mixing chamber and therefore in the region of the fuel feeder.

In a further embodiment, the fuel feeder comprises an annular duct extending around the mixing chamber and having at least one substantially radially entering fuel inlet duct and at least one substantially tangentially entering auxiliary air inlet duct. Preferably, there are two substantially diametrically opposed auxiliary air inlet ducts entering tangentially in the same sense into the annular duct, one of the air inlet ducts entering substantially at the entry position of the fuel duct. Furthermore, in this embodiment preferably a plurality of ducts lead from the annular duct in the air flow direction obliquely into the mixing chamber, the plurality of ducts being substantially uniformly distributed around the mixing chamber. The annular duct extending around the mixing chamber makes it possible, with the assistance of the constant pressure in the mixing chamber and the inlet ducts, to produce a uniform distribution of the fuel around the periphery of the tubular wall. By the provision of two auxiliary air ducts, an especially uniform premixing with a very good circumferential distribution can be achieved. Compared with a purely radial entry, the oblique entry of the inlet ducts connecting the annular duct with the mixing chamber provides the advantage that pronounced changes of flow direction and thus vortices and back-flow of the fuel are avoided.

The heating wall is preferably constructed in the form of a heat exchanger double wall through which in use, engine cooling water flows. This construction is particularly simple but can nevertheless basically be replaced or amplified by other types of heating, such as by electrical resistance heating and by heating with hot engine exhaust gas.

In one practical example, the choke valve is rotationally symmetrical and is movable rectilinearly in its axial direction, an annular air inlet opening, the flow area of which is controlled by the movement of the choke valve, being formed between the periphery of the choke valve and a widened-out portion of an air inlet, the choke valve being biased by a spring in the closure direction of the air inlet opening. Preferably, the widened-out portion widens out conically in the air flow direction in the region of the annular air inlet opening and the choke valve has a circular disc shape with a conical edge chamfer which is complementary to the widening-out. Due to the kinetic energy of the intake air and the pressure across the choke valve, the choke valve is so adjusted in the air flow direction that is in the opening direction that, with an appropriate conical widening-out and closure spring of appropriate spring rate, an opening position of the choke valve is obtained which in a function of the air flow rate. As a consequence it is possible to maintain the vacuum in the mixing chamber and in the flow stabilization conduit approximately constant and to actuate the metering element as a function of the air flow rate. The rectilinearly movable choke valve makes possible a direct mechanical coupling of the valve to the metering element without conversion of a pivotal movement into a linear movement.

In an alternative construction, a damper-like pivotal choke valve in the form of a butterfly valve and a closure spring which biases the valve in the closure direction are used. This more simple form of construction, which usually leads to more intensive vortices in the air flow can be employed owing to the provision of the flow stabilizing conduit, which removes the vortices again, and requires in general a conversion of the pivotal movement of the choke valve into a linear movement of the metering element.

In order to maintain as constant as possible the vacuum in the constant pressure conduit, a diaphragm box is preferably provided which adjusts the choke valve in the opening direction as a function of the vacuum obtaining in the mixing chamber and in opposition to the bias of the closure spring until equilibrium is achieved. This is appropriate particularly where a butterfly choke valve is used and constitutes a relatively simple, economical and also reliable acutuating element.

Independently of whether a pivotally or linearly movable choke valve is employed, this valve may be connected via a mechanical connection to the metering element which regulates the fuel flow rate. Instead of this, it is, however, alternatively possible to use an electrically inductive displacement pick-up which generates an electrical measuring signal corresponding to the position of the choke valve and thus to the air flow rate. In this case an electrical control device regulates the fuel flow rate as a function of the electrical measuring signal by means of an electrical solenoid which is connected to the metering element. The electrical control device may have means for providing at least one correction input signal for varying the fuel-air ratio as a function of at least one measured operating parameter of an engine. Such an arrangement is substantially more versatile than one which has a mechanical connection and can be better adapted to the relevant operating conditions. Moreover, in this case, the locations of the installation of the choke valve, or of the membrane box and of the fuel metering element are not of importance. Moreover, the basic setting of the carburettor can be carried out at the control device, so that for this purpose no modification of the closure spring is necessary.

Some examples of constant pressure carburettors in accordance with the invention are illustrated in the accompanying drawings in which.

In the descriptions of the various examples which now follow, corresponding parts have been given the same reference numerals, unless otherwise stated.

Figure 1:
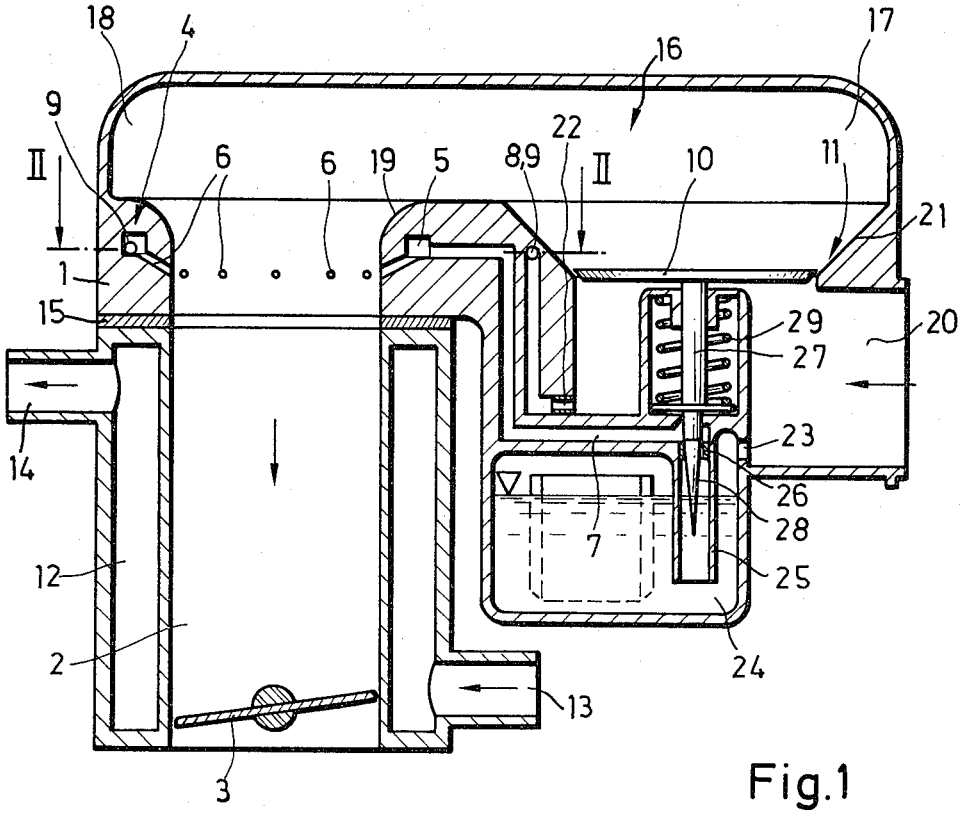
FIG. 1 is a diagrammatic longitudinal section of a first example.
Figure 2:
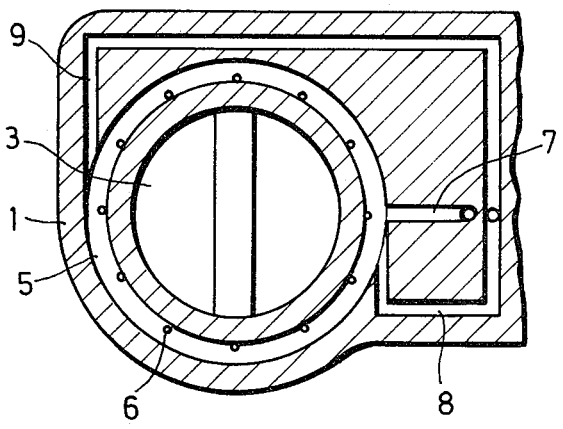
FIG. 2 is a cross-section on the line II—II of FIG. 1.

In the example of FIGS. 1 and 2, a tubular wall 1 surrounds a vertically extending mixing chamber 2, which is bounded downstream by an operator-actuated, in this example pivotal, main throttle valve 3. At the upstream end of the mixing chamber 2 there is a fuel feeder 4 having an annular duct 5 extending inside the wall 1 around the mixing chamber 2. The annular duct 5 is connected to the mixing chamber through a plurality of inlet ducts 6, which are distributed around the periphery of the mixing chamber 2. The ducts extend obliquely in the flow direction of the aspirated air into the mixing chamber 2. Through the inlet ducts 6, fuel or a premixture of fuel is drawn into the mixing chamber from the annular duct 5 by the constant vacuum in the mixing chamber 2. Into the annular duct 5 there lead substantially radially a fuel duct 7 and substantially tangentially two diametrically opposed auxiliary air ducts 8, 9. The entry position of the auxiliary air duct 8 is situated substantially at the entry position of the fuel duct 7.

A constant pressure passage of the constant pressure carburettor is bounded upstream by a rotationally symmetical disc-like, linearly movable choke valve 10. Depending upon the position of the choke valve 10, a greater or smaller annular air inlet opening 11 is provided between the outer circumferential edge of the choke valve 10 and a conical widening-out 21 at the entry to a flow stabilizing conduit 16.

In the region of the mixing chamber 2, that is between the fuel feeder 4 and the main throttle valve 3, the tubular wall 1 is formed as a heating wall 12. This is, in the present example, a heat exchanger double wall having an inlet 13 and an outlet 14 for engine cooling water to flow through. Instead of water heating or additionally thereto, electrical resistance heating and/or heating by engine exhaust gas may be provided. In order to prevent heating-up of the fuel feeder 4 and of the components adjacent thereto, such as a float chamber, the heating wall 12 is separated from the remaining upstream parts of the carburettor by thermal insulation 15.

Between the fuel feeder 4 and the choke valve 10, the flow stabilizing conduit 16 is situated. In this example the conduit has two bends 17 and 18, each of 90°. The bend 18, forming the transistion from the flow stabilizing conduit 16 into the mixing chamber 2 has a gradually tapering, uniformly rounded transistion 19. In this way, vortices in this transition region are avoided.

Upstream of the choke valve 10 there is an air inlet 20, which is bent through 90° and which leads via the widening-out 21 into the flow stabilization conduit 16. The air inlet 20 is connected via an air jet 22 to the auxiliary air ducts 8, 9 and via a vent 23 to a float chamber 24. In a dip pipe 25 inside the float chamber 24 there is a fuel jet 26, into which a conical, needle-like metering element 28 penetrates to a greater or lesser extent as a function of the instantaneous fuel flow rate. The metering element 28 is connected by a rod 27 to the choke valve 10 and is biased by means of a closure spring 29 in a direction to close the air inlet opening 11. The choke valve 10 is raised in the direction of flow by the kinetic energy of the intake air and by the pressure difference between the chamber 2 and the inlet 20. The arrangement is such that the opening of the choke valve 10 is a function of the air flow rate. The spring rate of the closure spring 29 must be so selected that the self-weight of the choke valve 10 does not adversely influence the movement. In this way it is possible to prevent a sudden movement of the carburettor or of a vehicle in which the carburettor is fitted from resulting in an undesired opening or closing movement of the choke valve, which would lead to a change of the fuel-air ratio and to adverse running of the engine.

From the float chamber 24 the fuel passes through the dip pipe 25, the fuel jet 26 and the fuel duct 7 into the annular duct 5 of the fuel feeder 4, where it is mixed with the air from the auxiliary air ducts 8, 9 to produce a premixture and is uniformly distributed. Thereafter the premixture passes via the inlet ducts 6 into the mixing chamber 2.

The second example shown in FIGS. 3 and 4 differs from the first example only in a few details, which will now be explained. In other respects reference should be made to the description of FIGS. 1 and 2.

Figure 3:
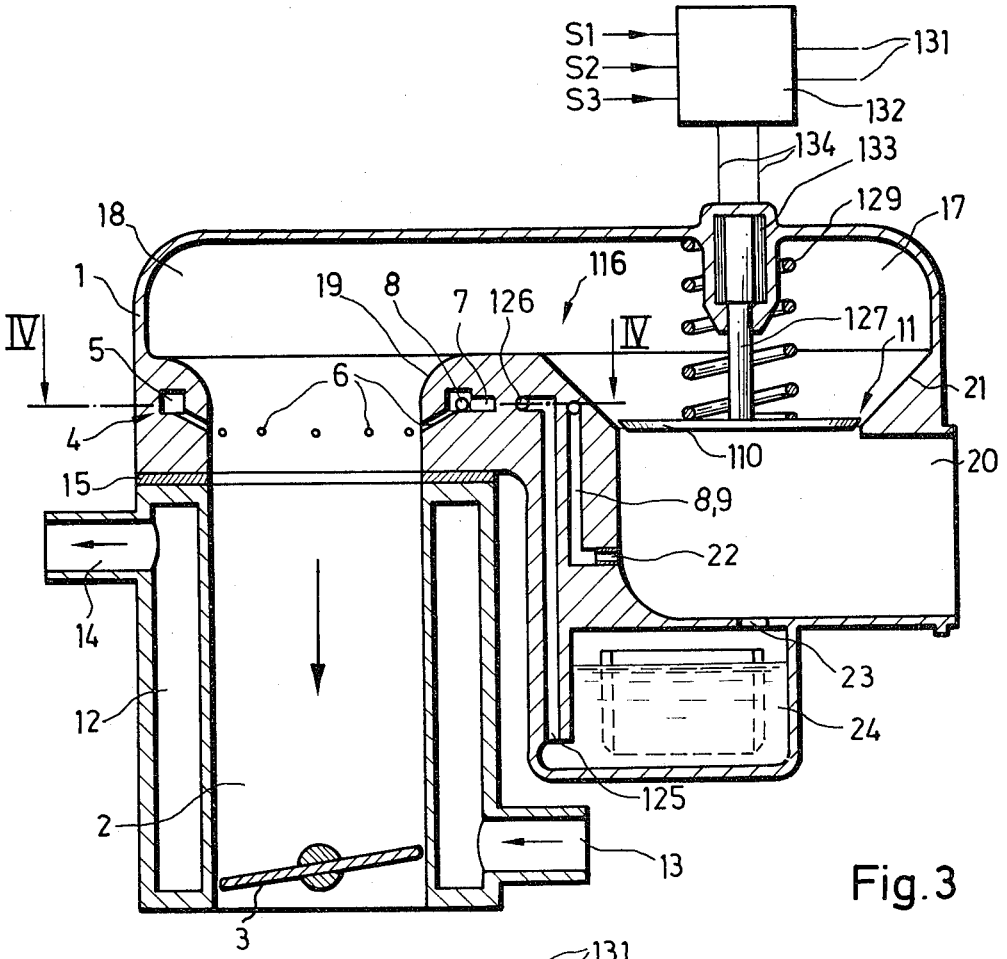
FIG. 3 is a diagrammatic longitudinal section of a second example.
Figure 4:
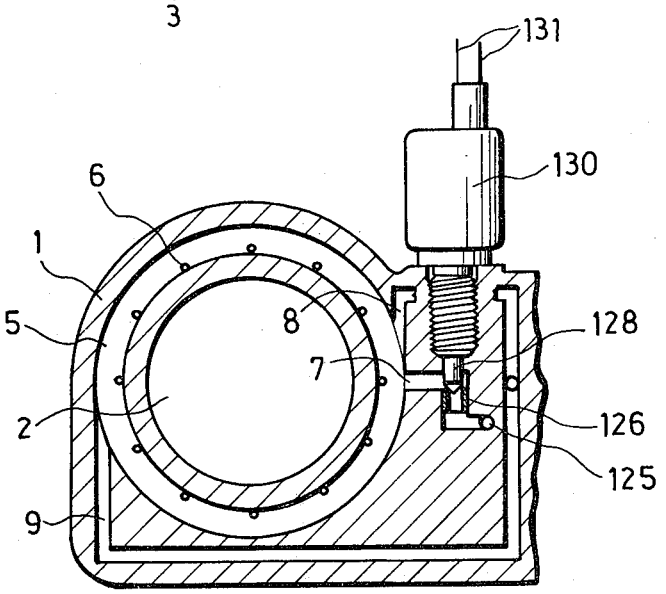
FIG. 4 is a cross-section on the line IV—IV of FIG. 3.

The flow stabilizing conduit 116 shown in FIG. 3 corresponds to the flow stabilizing conduit 16 of FIG. 1. As a difference from FIG. 1 the choke valve 110 shown in FIG. 3 which is formed in itself like the choke valve 10, does not have any mechanical connection with a fuel metering element. The fuel is sucked out of the float chamber 24 via a dip pipe 125 through a fuel jet 126, which can be closed to a greater or lesser extent by a needle-like conical metering element 128. The fuel flow passing into the fuel duct 7 is controlled by means of a solenoid 130 connected to the metering element 128. This solenoid is connected via electrical conductors 131 to a control device 132, which is energised via input electrical conductors 13 by a measurement signal representing the opening position of the choke valve 110. The control device 132 has, in the present example, three correction value inputs for changing the fuel/air ratio produced by the carburettor as a function of measured operating parameters $S_1$, $S_2$, $S_3$.

The electrical conductors 134 at the input side of the control device 132 are connected to a stationary coil 133 of an inductive linear displacement pick-up, which also comprises a rod 127, which is connected to the choke valve 110 and acts as an armature. The rod 127 extends, according to the position of the choke valve 110, for a greater or lesser distance into the coil 133, so that a measurement signal corresponding to the position of the choke valve is produced in the conductors 134. By means of the control device 132, the solenoid 130 can thus be controlled as a function of the instantaneous air flow rate and of other correction values. The basic setting of the fuel flow rate and the correction of the fuel-air ratio, for example at a cold start, during running-up or in an a altitude correction, is undertaken directly by the control device 132.

Figure 5:
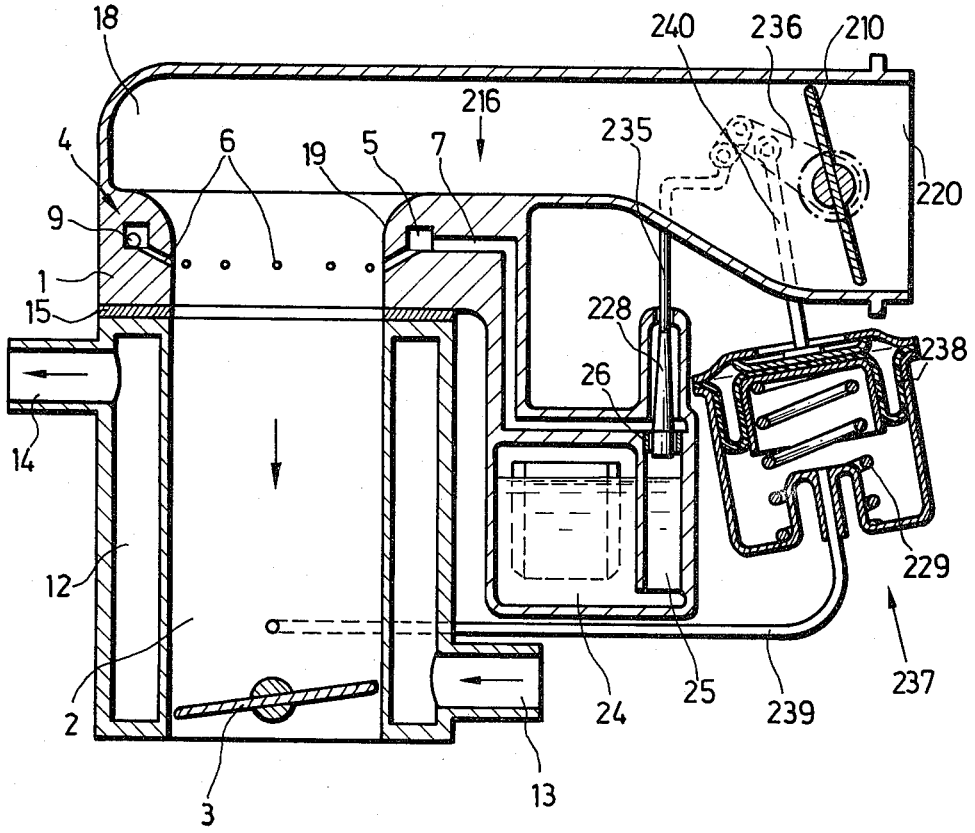
FIG. 5 is a diagrammatic longitudinal section of a third example.

The third example shown in FIG. 5 differs from the first two examples substantially in the type and actuation of the choke valve 210 and in the form of the flow stabilising conduit 216. Therefore, only the differences of this example will be explained, whereas reference should be made to the preceding description in respect of the other details.

The flow stabilization conduit 216 in the example of FIG. 5, which is situated above the vertical mixing chamber 2, has only at its downstream end a bend 18 of 90°. A bend at the inlet end, corresponding to the bend 17 of FIG. 1, is not provided, so that the flow stabilizing conduit 216 opens via a straight air inlet 220 in a horizontal direction. A choke valve 210, which is formed as a pivotal damper or butterfly valve, is situated in a region of widened out cross-section in the flow stabilizing conduit 216. A metering element 228 corresponding to the metering element 28 of the example of FIGS. 1 and 3 is connected by a connecting rod 235 to a lever 236 which is rigidly connected to the choke valve 210 so that when the choke valve 210 opens an increase in the flow cross-section for the fuel also occurs at the fuel jet 26.

As shown in FIG. 5, the choke valve 210 is so adjusted by means of a diaphragm box 237 that a constant vacuum obtains in the constant pressure part of the carburettor that is in the conduit 216 and the chamber 2. Inside the diaphragm box 237, a diaphragm 238 which subdivides the box into two chambers is biased by a closure spring 229 so that the diaphragm 238 presses the choke valve 210 in the closure direction via an actuating rod 240, which is pivotally connected to the lever 236. The chamber of the diaphragm box 237 remote from the side of the actuating rod 240 is connected via a vacuum line 239 to the mixing chamber 2. The diaphragm box 237 is so constructed that constant vacuum conditions become established in the mixing chamber 2. The pivotal position of the choke valve 210 is a function of the instantaneous air flow rate and is converted via the connecting rod 235 into a linear movement of the metering element 228.

The fourth example shown in FIG. 6 differs from the third example only in some details, which will now be explained. In other respects, reference should be made to the foregoing description.

Figure 6:
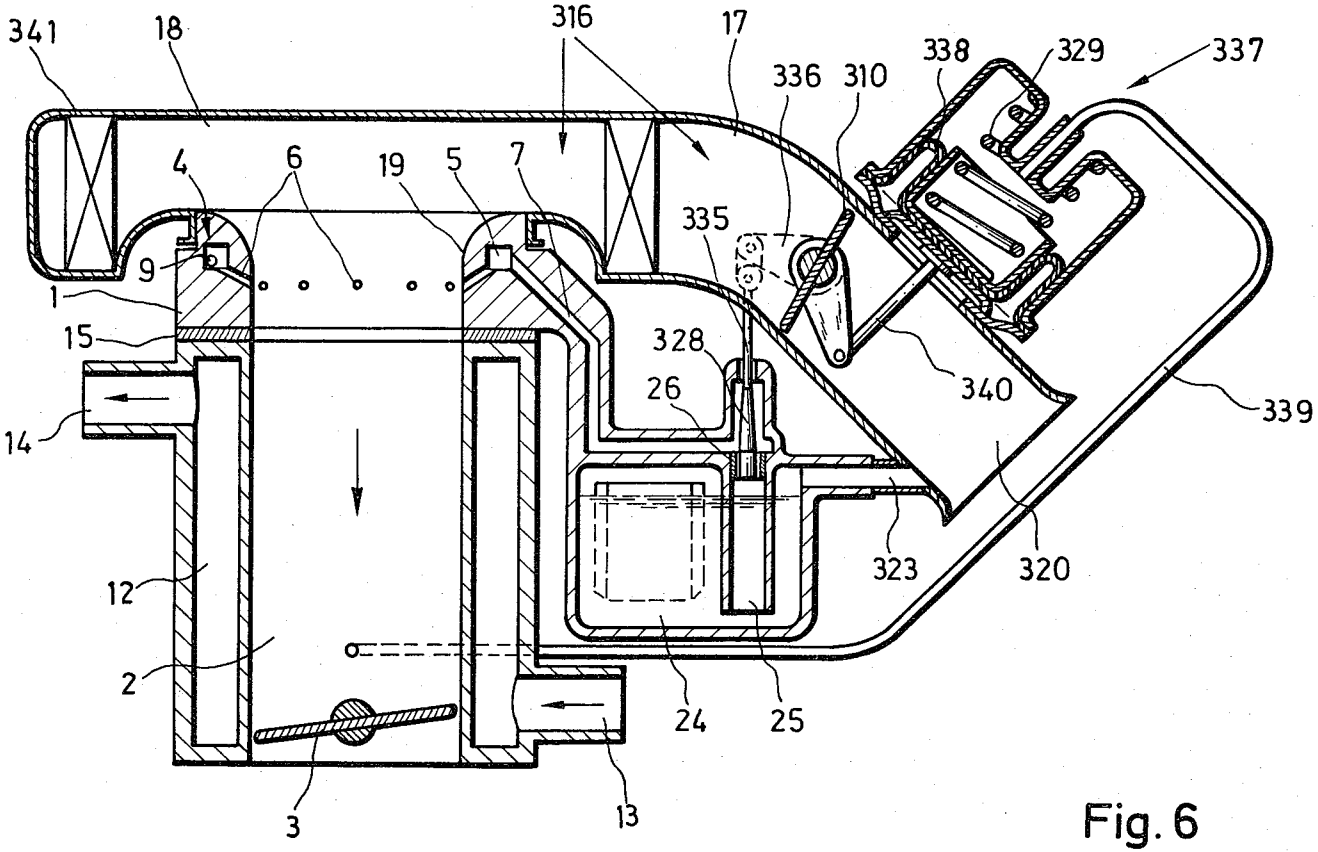
FIG. 6 is a diagrammatic longitudinal section of a fourth example.

The flow stabilizing conduit 316 shown in FIG. 6 has a total bending deflection of approximately 135° which is subdivided into a first bend 17 of about 45° and a second bend 18 of 90°, passing into the mixing chamber 2. In the flow stabilizing conduit 316 there is an annular air filter 341, which extends around the inlet region of the mixing chamber 2 or around the transition 19 in such a manner that the intake air can flow circumferentially around the air filter 341. The air passes through the air filter 341 and flows from within the filter into the mixing chamber 2. As in the example of FIG. 5, a straight air inlet 320 adjoins the flow stabilizing conduit 316 at the inlet end and this air inlet opens obliquely downwards at a slope of about 45°.

As in the example of FIG. 5, a choke valve 310, which is formed as a pivotal damper or butterfly valve, is connected via lever 336 and a connecting rod 335 pivotally connected thereto with a linearly movable metering element 238, which controls the free passage cross-section of the fuel jet 26 in dependence on the air flow rate and the position of the choke valve 310. The float chamber 24 is connected via a vent 323 to the air inlet 320.

The choke valve 310 is, as in the example of FIG. 5, so adjusted by means of a diaphragm box 337 that constant vacuum conditions become established in the mixing chamber 2. A diaphragm 338 is coupled via an actuating rod 340 to the choke valve 310 and is biased by the closure spring 329 in the direction of closure of the choke valve 310.

The diaphragm 338 is adjusted via the vacuum line 339, connected with the mixing chamber 2, against the action of the closure spring 329 in the direction of opening of the choke valve 310. The position of the choke valve 310 and thus also of the metering element 328 is a function of the instantaneous air flow rate.

The various examples can be modified in many ways in respect of their details of construction. This applies particularly to the construction of the flow stabilizing conduit and also of the heating wall and the choke valve. In this connection it is of importance that in the region of the fuel feeder and of the heating wall, quasi-laminar flow conditions without vortices should become established and that the speed of flow of the air passing directly along the heating wall should not be too large in order that an effective mixture preparation by evaporation of the fuel can be attained.

We claim:

1. A constant pressure carburettor for an internal combustion engine, said carburettor comprising a tubular wall defining a main air flow path and a mixture chamber, fuel feeder means at the upstream end of said chamber for supplying fuel in a substantially uniform circumferential distribution onto said tubular wall, a main throttle valve downstream of said mixture chamber, means forming a heating wall in a part at least of said tubular wall between said fuel feeder means and said main throttle valve, a choke valve disposed upstream of said fuel feeder means, a metering element which regulates the rate of fuel flow from said fuel feeder means, means for opening said choke valve in dependence upon the magnitude of the air flow along said main air flow path and means operatively connecting said choke valve and said metering element to actuate said metering element in dependence upon the opening of said choke valve, means defining an air flow stabilising conduit extending between said choke valve and said fuel feeder means, said stabilising conduit being operatively constructed to damp out or decrease vortices generated in said air flow by said choke valve before said air flow reaches said mixing chamber.

2. A carburettor as claimed in claim 1, further comprising means for supporting said carburettor in an operative position, said heating wall being vertical when said carburettor is in said operative position and said fuel feeder means being above said heating wall.

3. A carburettor as claimed in claim 1, in which said means defining said stabilizing conduit defines at least one bend along the length of said conduit.

4. A carburettor as claimed in claim 3, in which said at least one bend has an angle or an aggregate angle in the range of from about 90° to about 180°.

5. A carburettor as claimed in claim 1, further comprising air filter means in said stabilizing conduit.

6. A carburettor as claimed in claim 5, in which said air filter means is annular and includes an inside and an outer periphery, means communicating said inside of said annular filter means with said mixing chamber and means for flowing air around said outer periphery of said filter means.

7. A carburettor as claimed in claim 1, including means defining a transition between said flow stabilizing conduit and said mixing chamber, said transition tapering gradually from said conduit to said mixing chamber.

8. A carburettor as claimed in claim 1, in which said fuel feeder means includes means defining an annular duct extending around said mixing chamber, means defining at least one fuel inlet duct extending substantially radially into said annular duct and means defining at least one auxiliary air inlet duct extending substantially tangentially into said annular duct.

9. A carburettor as claimed in claim 8, including means defining two substantially diametrically opposed auxiliary air inlet ducts, said air inlet ducts entering said annular duct tangentially in the same sense as each other and one of said air inlet ducts entering said annular duct adjacent the entry of said fuel duct into said annular duct.

10. A carburettor as claimed in claim 9, further comprising means defining a plurality of further ducts leading from said annular duct into said mixing chamber, said further ducts extending obliquely from said annular duct into said mixing chamber in the direction of said air flow to said mixing chamber, said further ducts being substantially uniformly distributed around said mixing chamber.

11. A carburettor as claimed in claim 1, in which the said heating wall comprises a double wall heat exchange means defining a heating chamber, an inlet to said heating chamber, and an outlet from said heating chamber for the flow through said chamber of engine cooling water.

12. A carburettor as claimed in claim 1, in which said choke valve includes a rotationally symmetrical choke valve member and means mounting said choke valve member for linear movement in a direction axially thereof, and further comprising means defining an air inlet to said carburettor, means defining a widened-out portion of said air inlet and an annular air inlet opening defined between the periphery of said choke valve member and said widened-out portion of said air inlet, said annular air inlet opening having a variable flow area which is controlled by said linear movement of said choke valve member, and spring means biasing said choke valve member in a direction to decrease said flow area of said annular air inlet opening.

13. A carburettor as claimed in claim 12, in which said widened-out portion widens out conically in the direction of said air flow in the region of said annular air inlet opening, and said choke valve member comprising circular disc means and means defining a conical edge chamfer around said disc means, said conical edge chamfer being complementary to said widened-out portion.

14. A carburettor as claimed in claim 1, in which said choke valve is a butterfly valve which includes spring means biasing said butterfly valve in a closure direction.

15. A carburettor as claimed in claim 14, further comprising a diaphragm box, a diaphragm in said box defining first and second chambers in said box, one of said chambers being on each side of said diaphragm, means connecting said diaphragm to said choke valve and means communicating said mixing chamber with one of said chambers in said diaphragm box, whereby a vacuum obtaining in said mixing chamber moves said choke valve in opposition to said bias of said spring to open said choke valve until equilibrium between said vacuum and said bias acting on said choke valve is reached.

16. A carburettor as claimed in claim 1, further comprising mechanical connection means connecting said choke valve to said metering element to regulate said fuel flow rate.

17. A carburettor as claimed in claim 1, further comprising electrically inductive displacement pick-up means connected to said choke valve, said pick-up means being operative to generate an electric measuring signal corresponding to the opening position of said choke valve, an electrical control device, means for transmitting said measuring signal to said electrical control device, electrical solenoid means connected to said metering element and means connecting said electrical control device to said electrical solenoid means whereby said electrical solenoid means regulates said fuel flow rate as a function of said electrical measuring signal.

18. A carburettor as claimed in claim 17, in which said electrical control means includes means for providing at least one correction input signal for varying said fuel flow rate in relation to said air flow to vary the fuel-air ratio as a function of at least one measured operating parameter of an internal combustion engine.

* * * * *